US012765666B2

(12) United States Patent
Chen

(10) Patent No.: US 12,765,666 B2
(45) Date of Patent: Oct. 20, 2026

(54) EASY-TO-TRANSPORT SQUARE TABLE

(71) Applicant: SOPHIA & WILLIAM BRANDS CO. LTD, Nanjing (CN)

(72) Inventor: Meidi Chen, Nanjing (CN)

(73) Assignee: SOPHIA & WILLIAM BRANDS CO. LTD., Nanjing (CN)

( * ) Notice: Subject to any disclaimer, the term of this patent is extended or adjusted under 35 U.S.C. 154(b) by 40 days.

(21) Appl. No.: 19/057,631

(22) Filed: Feb. 19, 2025

(65) Prior Publication Data

US 2026/0240317 A1 Aug. 20, 2026

(51) Int. Cl.
*A47B 37/04* (2006.01)
*A47B 13/00* (2006.01)

(52) U.S. Cl.
CPC ..... *A47B 37/04* (2013.01); *A47B 13/003* (2013.01)

(58) Field of Classification Search
CPC ..... A47B 3/06; A47B 3/12; A47B 13/003; A47B 13/02; A47B 13/021; A47B 13/08; A47B 13/088; A47B 2013/006; A47B 2013/022; A47B 37/04
See application file for complete search history.

(56) References Cited

U.S. PATENT DOCUMENTS

| | | | | | |
|---|---|---|---|---|---|
| 2,585,111 | A * | 2/1952 | Grauer | A47B 3/12 108/69 |
| 3,347,509 | A * | 10/1967 | Blink | A47B 3/12 108/150 |
| D856,048 | S * | 8/2019 | Tham | D6/689 |
| 2025/0143447 | A1* | 5/2025 | Zheng | A47B 13/02 |
| 2026/0123744 | A1* | 5/2026 | He | A47B 37/04 |

FOREIGN PATENT DOCUMENTS

| | | | | |
|---|---|---|---|---|
| CN | 202280709 U | * | 6/2012 | A47B 13/003 |
| CN | 202445441 U | | 9/2012 | |
| CN | 107772784 A | | 3/2018 | |
| CN | 209436658 U | | 9/2019 | |
| CN | 221599446 U | * | 8/2024 | A47B 3/06 |
| DE | 102014114665 A1 | * | 4/2016 | A47B 13/02 |
| DE | 202024101809 U1 | * | 4/2024 | A47B 13/021 |
| KR | 0129418 Y1 | * | 12/1998 | A47B 13/021 |
| KR | 200441590 Y1 | * | 8/2008 | |
| KR | 20090126037 A | * | 12/2009 | A47C 15/004 |
| KR | 200492567 Y1 | * | 11/2020 | A47B 13/021 |
| KR | 1020240057177 A | * | 5/2024 | A47B 13/08 |
| WO | WO-2005120288 A1 | * | 12/2005 | A47B 13/02 |

* cited by examiner

*Primary Examiner* — Andrew Roersma
(74) *Attorney, Agent, or Firm* — George D. Morgan

(57) ABSTRACT

The present invention relates to the technical field of square tables, and in particular, to an easy-to-transport square table, including a square table. A table leg is disposed at four corners on a bottom portion of the square table respectively, and the table leg is connected to a frame. A table plate A and a table plate B are disposed on the frame respectively, and the table plate A is docked with the table plate B to form the square table. According to the square table, an entire table is divided into the table plate A and the table plate B through the frame, and an area of an entire table plate is reduced, thereby reducing transportation costs and facilitating carrying of a user.

8 Claims, 9 Drawing Sheets

EASY-TO-TRANSPORT SQUARE TABLE

TECHNICAL FIELD

The present invention relates to the technical field of square tables, and in particular, to an easy-to-transport square table.

BACKGROUND

Outdoor square tables are pieces of furniture suitable for outdoor use, which are usually weather-resistant and stable.

Currently, the existing square tables on the market are all of integral structures, and only the table plate and table legs can be detached. Since the entire table plate is large, when the entire table plate is transported, the table plate area is large, resulting in high transportation costs. The user needs to mount the detached structures of the table plate and table legs himself. Since the entire table plate is heavy, it is troublesome, laborious, and inconvenient for the user to mount the entire table plate.

Therefore, the present applicant provides an easy-to-transport square table, to solve the problems in the above background.

SUMMARY

The present invention aims to provide an easy-to-transport square table, to solve problems of a large area, high transportation costs, inconvenient carrying, and the like of an existing square table.

To solve the above technical problems, the present invention provides an easy-to-transport square table, including a square table, where a table leg is disposed at four corners on a bottom portion of the square table respectively, the table leg is connected to a frame, a table plate A and a table plate B are disposed on the frame respectively, and the table plate A is docked with the table plate B to form the square table.

A further improvement of the technical solution of the present invention is that: the frame further includes a frame A and a frame B, a liner is disposed at an extension end of a body of the frame A, and the liner adapts to and is embedded in an extension hole provided at an extension end of a body of the frame B.

A further improvement of the technical solution of the present invention is that: an angle block is disposed on bottom portions at two corners of the body of the frame A respectively, the liner is disposed at the extension end of the body of the frame A, and a side surface of a body of the liner is provided with a penetrating hole in a penetrating manner.

A further improvement of the technical solution of the present invention is that: an angle block is disposed on bottom portions at two corners of the body of the frame B respectively, the extension end of the body of the frame B is provided with the inner cavity extension hole, and a side surface of a body of the extension hole is provided with a penetrating hole A in a penetrating manner.

A further improvement of the technical solution of the present invention is that: a penetrating hole on a body of the liner overlaps and adapts to a penetrating hole A on a body of the extension hole.

A further improvement of the technical solution of the present invention is that: a cross support mechanism is disposed on a bottom portion of a docked surface between the table plate A and the table plate B, a middle portion of a body of the cross support mechanism adapts to an outer wall of a sleeve ring, a cover plate is mounted on a top portion of a body of the sleeve ring, and the cover plate is movably mounted and is configured to allow an umbrella pole to be inserted.

A further improvement of the technical solution of the present invention is that: the cross support mechanism further includes a long rod and a short rod, the long rod and the short rod are disposed perpendicular to each other, and two ends of a body of the long rod are fixed to the table plate A and the table plate B through a screw A.

A further improvement of the technical solution of the present invention is that: a short handle is disposed on two ends of a body of the short rod respectively, and the short handle is fixed to the table plate A and the table plate B through a screw B.

A further improvement of the technical solution of the present invention is that: a top portion of the table leg adapts to and abuts against an angle block, and the angle block fixes the table leg through a plurality of bolts.

A further improvement of the technical solution of the present invention is that: the table plate A and the table plate B are integrally formed with any one of the frame A and the frame B respectively.

The present invention has the following beneficial effects after adopting the above technical solutions:

1. According to the easy-to-transport square table provided in the present invention, the entire table is divided into the table plate A and the table plate B through the frame, the table plate A and the table plate B are assembled into the entire square table by docking and combining the frame A and the frame B, and when transportation is needed, the table plate A and the table plate B are divided by detaching the screw, to reduce the area of the entire table plate, thereby reducing transportation costs and facilitating the carrying of the user.
2. According to the easy-to-transport square table provided in the present invention, the liner in the frame A is sleeved in and adapts to the extension hole in the frame B, so that the frame A is docked with the frame B to form the entire square table, and the liner and the extension hole are provided, to reduce the area of the square table, facilitate the carrying of the user, and enhance the stability of the square table.
3. According to the easy-to-transport square table provided in the present invention, the cross support mechanism is disposed on the bottom portion of the docked position between the table plate A and the table plate B, so that the stability and firmness of the square table are enhanced; and the middle portion of the cross support mechanism is sleeved on the sleeve ring, the sleeve ring penetrates and adapts to the entire thickness of the square table, and the stability of the table plate A, the table plate B, and the cross support mechanism is further enhanced through the sleeve ring.

BRIEF DESCRIPTION OF THE DRAWINGS

To describe the technical solutions in the specific embodiments of the present invention or in the prior art more clearly, the following briefly describes the accompanying drawings needed for describing the specific embodiments or the prior art. Apparently, the accompanying drawings in the following description show some embodiments of the present invention, and those of ordinary skill in the art may further derive other accompanying drawings from these accompanying drawings without creative labor.

Figure 1:
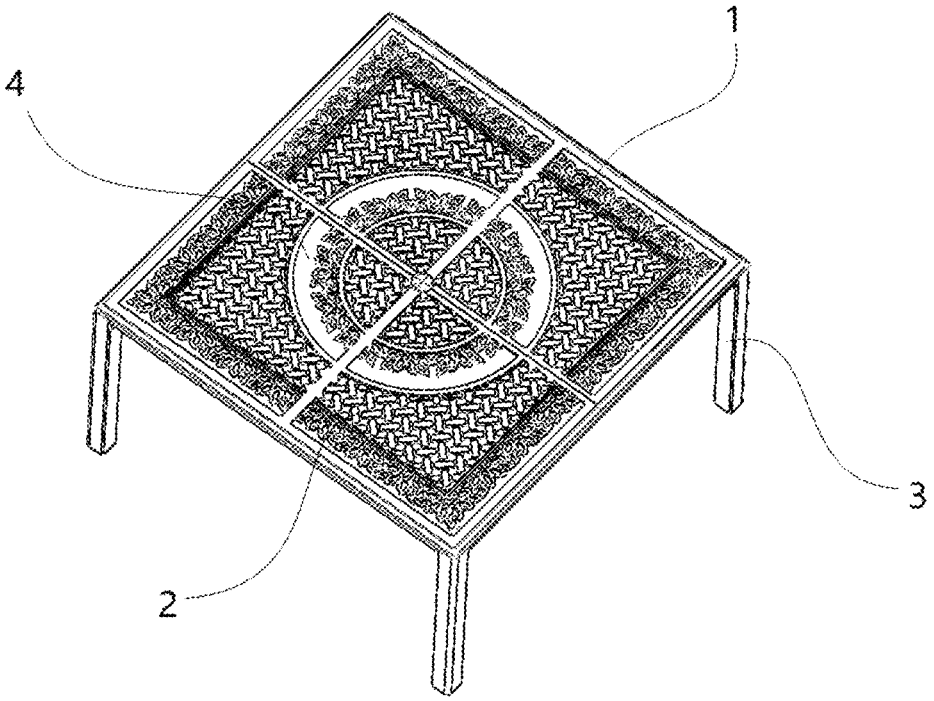
FIG. 1 is a schematic diagram of an overall structure of an easy-to-transport square table.

Reference numerals: 1. table plate A; 2. table plate B; 3. table leg; 4. square table; 5. frame; 6. cover plate; 7. cross support mechanism; 8. angle block; 9. bolt; 10. long rod; 11. screw A; 12. short handle; 13. screw B; 14. short rod; 15. sleeve ring; 51. frame A; 52. frame B; 53. liner; 54. extension hole; 55. penetrating hole; 56. penetrating hole A.

DETAILED DESCRIPTION OF THE EMBODIMENTS

An explicit and complete description of the technical solutions in the present invention is given below in conjunction with the accompanying drawings. Apparently, the described embodiments are part not all of the embodiments of the present invention. Based on the embodiments in the present invention, all other embodiments obtained by those of ordinary skill in the art without making creative labor fall within the scope of protection of the present invention.

In the description of the present invention, it should be noted that, the orientations or positional relationships indicated by the terms "center", "up", "down", "left", "right", "vertical", "horizontal", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first", "second", "third" are used for descriptive purposes only and are not allowed to be construed as indication or implication of relative importance.

In the description of the present invention, it should be noted that, unless otherwise explicitly provided and limited, the terms "mounted", "attached", "connected" should be understood in a broad sense, e.g., it may be a fixed connection, a detachable connection or an integral connection; it may be a mechanical connection or an electrical connection; it may be a direct attachment, or an indirect attachment through an intermediate medium; and it may be a communication within two elements. For those of ordinary skill in the art, the specific meaning of the above-mentioned terms in the present invention can be construed according to specific cases.

The present invention is further explained and illustrated below in conjunction with specific embodiments.

Figure 2:
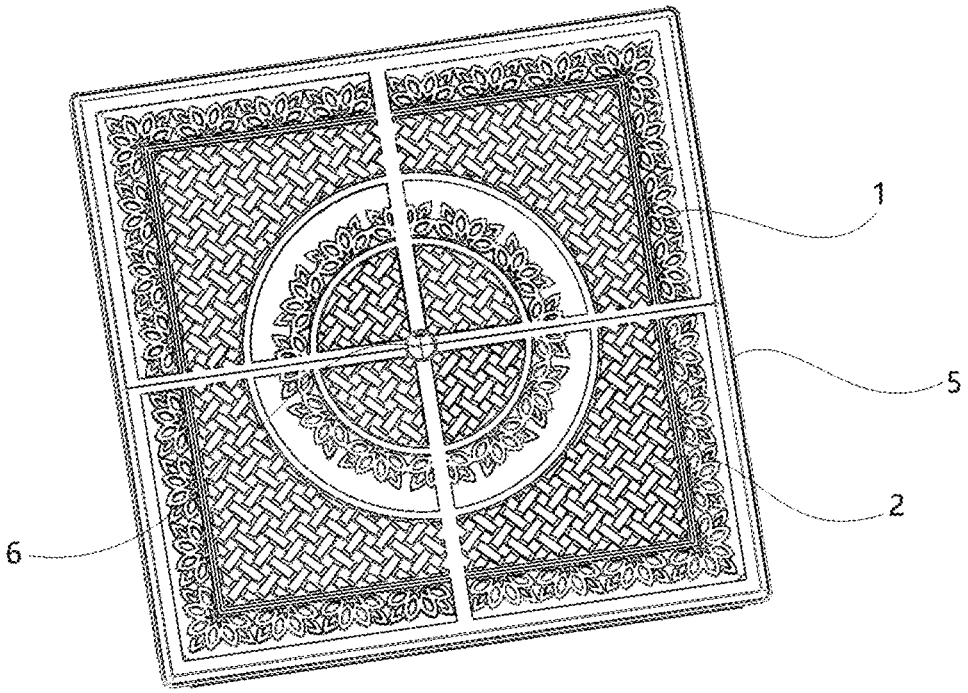
FIG. 2 is a schematic structural diagram of a square table.
Figure 3:
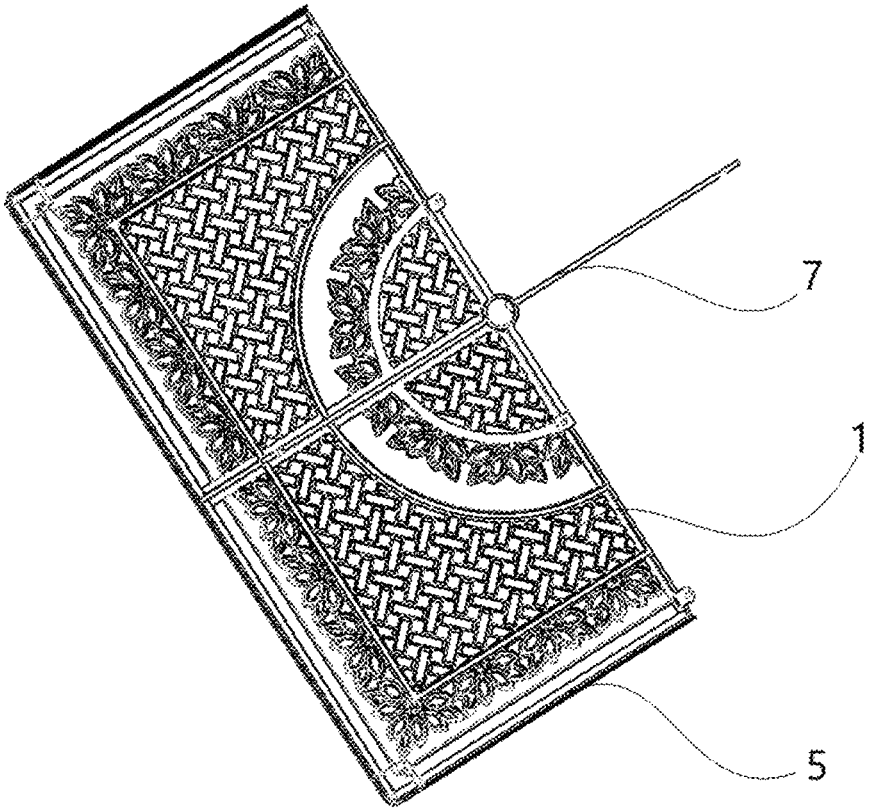
FIG. 3 is a schematic structural diagram of a table plate A.
Figure 4:
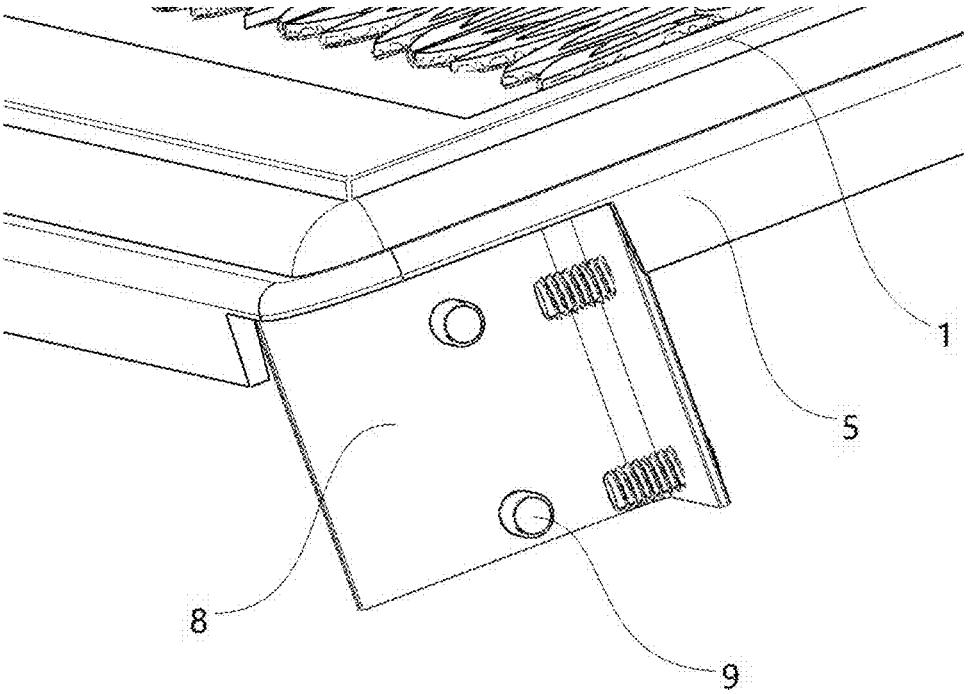
FIG. 4 is a schematic structural partial diagram of a frame and an angle block.
Figure 5:
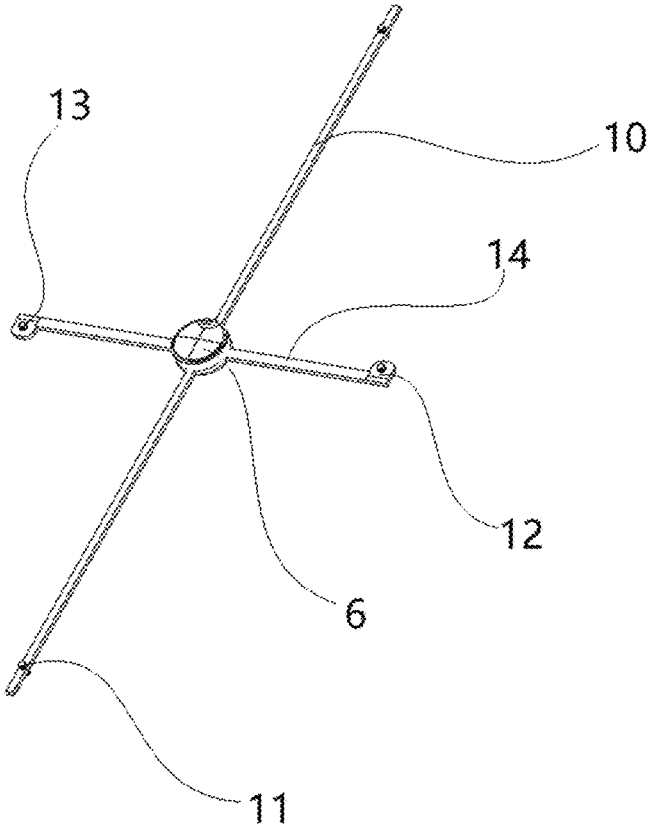
FIG. 5 is a schematic structural diagram of a cross support mechanism.
Figure 6:
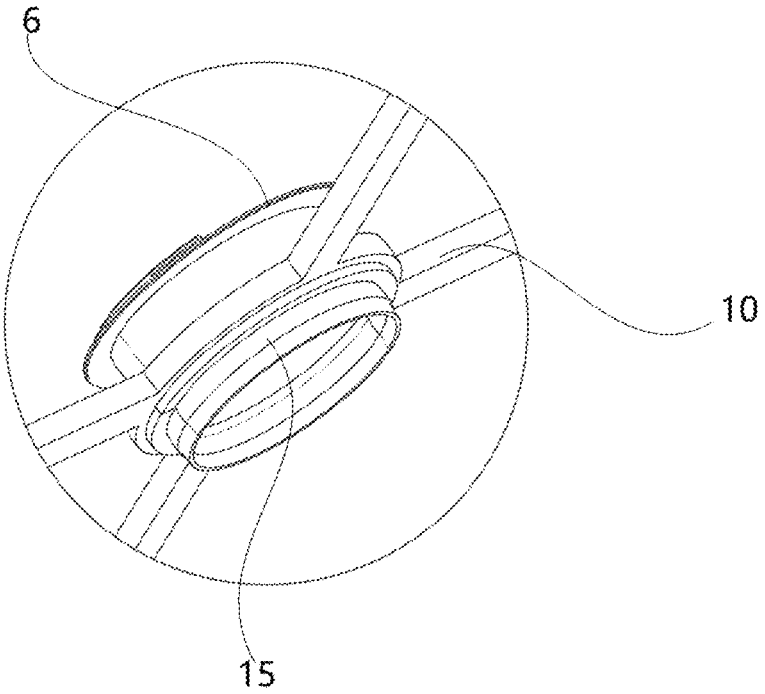
FIG. 6 is a schematic structural diagram of a sleeve ring.
Figure 7:
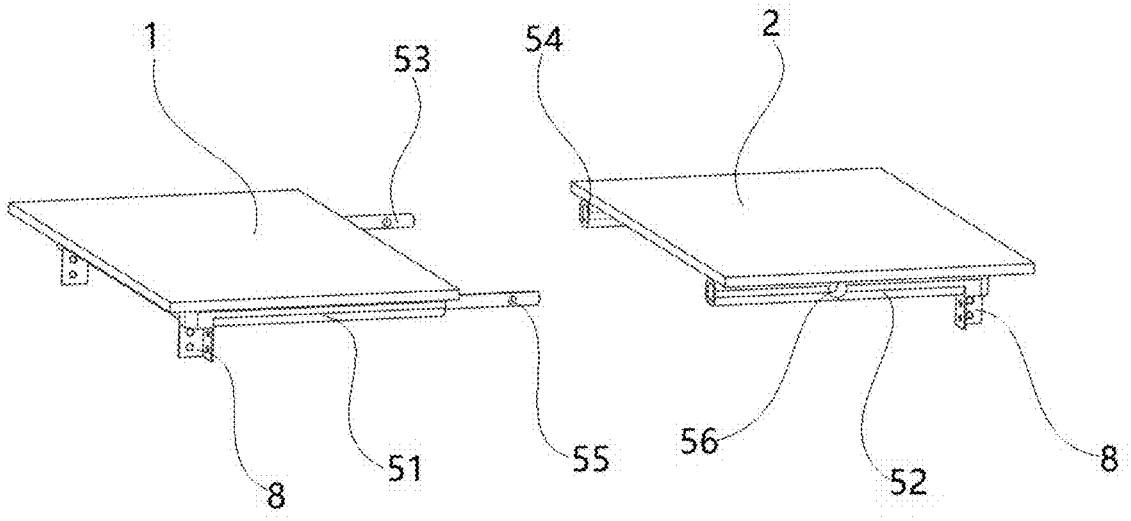
FIG. 7 is a schematic structural exploded view of a frame A and a frame B.
Figure 8:
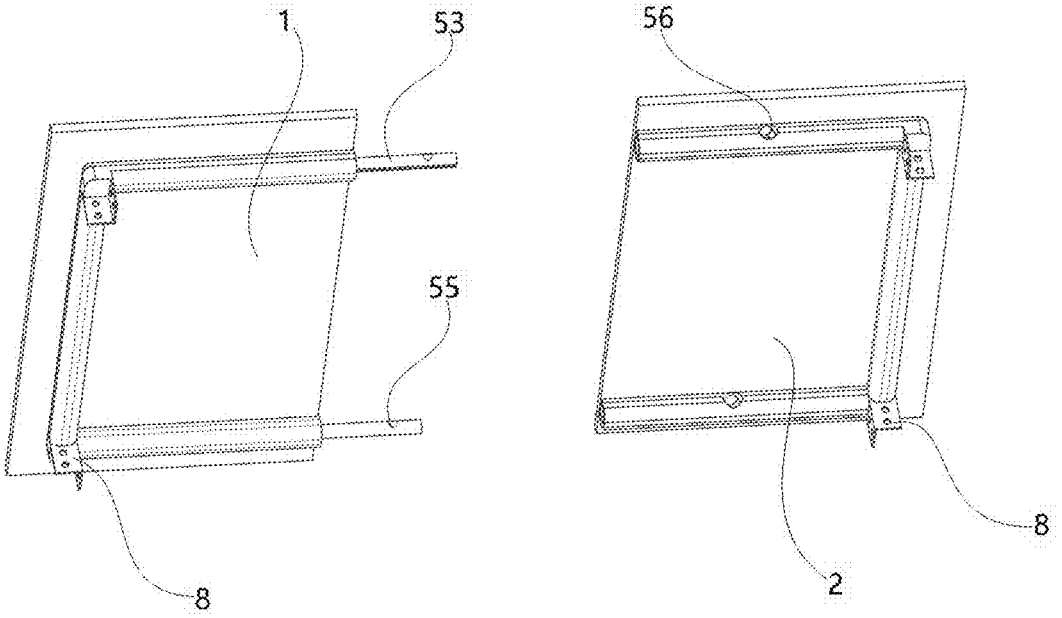
FIG. 8 is a schematic structural exploded view of a frame A and a frame B.
Figure 9:
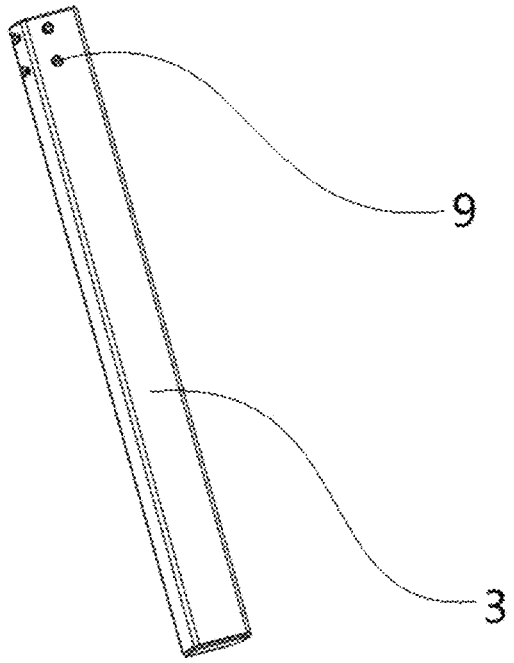
FIG. 9 is a schematic structural diagram of a table leg.

As shown in FIG. 1 to FIG. 9, an embodiment provides an easy-to-transport square table, including a square table 4. A table leg 3 is disposed at four corners on a bottom portion of the square table 4 respectively, and the table leg 3 is connected to a frame 5. A table plate A 1 and a table plate B 2 are disposed on the frame 5 respectively, and the table plate A 1 is docked with the table plate B 2 to form the square table 4. The table plate A 1 and the table plate B 2 are integrally formed with any one of a frame A 51 and a frame B 52 respectively. A top portion of the table leg 3 adapts to and abuts against an angle block 8, and the angle block 8 fixes the table leg 3 through a plurality of bolts 9. Four table legs 3 are disposed at the four corners on the bottom portion of the square table 4, and the table legs 3 are fixed on the frame 5 through four bolts 9. The frame 5 further includes the frame A 51 and the frame B 52, and the table plate A 1 and the table plate B 2 are fixed on the frame A 51 and the frame B 52 respectively. The frame A 51 is docked and combined with the frame B 52, so that the table plate A 1 and the table plate B 2 are combined to form the entire square table 4. According to the square table, the entire table is divided into the table plate A and the table plate B through the frame, and the table plate A and the table plate B are assembled into the entire square table by docking and combining the frame A and the frame B. When transportation is needed, the table plate A and the table plate B are separated by detaching a screw to reduce an area of the entire table plate, thereby reducing transportation costs and facilitating carrying of a user.

As shown in FIG. 2 to FIG. 4, FIG. 7, and FIG. 8, in the embodiment, the frame 5 further includes the frame A 51 and the frame B 52. A liner 53 is disposed at an extension end of a body of the frame A 51, the liner 53 is movably connected or fixedly connected, and the liner 53 may be designed according to a requirement of the user. A movable connection of the liner 53 is convenient for the user to adjust the length of the liner 53, and a fixed connection of the liner 53 is convenient for the user to dock and splice the frame B. The liner 53 adapts to and is embedded in an extension hole 54 provided at an extension end of a body of the frame B 52. The angle block 8 is disposed on bottom portions at two corners of the body of the frame A 51 respectively, the liner 53 is disposed at the extension end of the body of the frame A 51, and a side surface of a body of the liner 53 is provided with a penetrating hole 55 in a penetrating manner. The angle block 8 is disposed on bottom portions at two corners of the body of the frame B 52, the extension end of the body of the frame B 52 is provided with the inner cavity extension hole 54, and a side surface of a body of the extension hole 54 is provided with a penetrating hole A 56 in a penetrating manner. The penetrating hole 55 of the body of the liner 53 overlaps and adapts to the penetrating hole A 56 of the body of the extension hole 54. The frame 5 is formed by combining and splicing the frame A 51 and the frame B 52. Two liners 53 are disposed at extension ends of the frame A 51, and two inner cavity extension holes 54 are disposed on bodies of extension ends of the frame B 52. The liners 53 adapt to and are sleeved in the two inner cavity extension holes 54, and the length, diameter, depth, and inner diameter of the liner 53 and the extension hole 54 may be customized according to the requirement of the user. The liner 53 and the extension hole 54 are fixed by penetrating the screw into the penetrating hole 55 and the penetrating hole A 56 in an overlapping manner. Two angle blocks 8 are symmetrically disposed on bottom portions at two corners of the frame A 51 and the frame B 52 respectively, and the angle block 8 adapts to and abuts against any one of edges of the square table leg 3 and is fixed through four bolts 9. According to the square table, the liner 53 in the frame A is sleeved in and adapts to the extension hole in the frame B, so that the frame A is docked with the frame B to form the entire square table. The liner and the extension hole are provided, to reduce an area of the square table, facilitate carrying of the user, and enhance stability of the square table at the same time.

As shown in FIG. 2, FIG. 3, FIG. 5, and FIG. 6, in the embodiment, a cross support mechanism 7 is disposed on a bottom portion of a docked surface between the table plate A 1 and the table plate B 2, a middle portion of a body of the cross support mechanism 7 adapts to an outer wall of a sleeve ring 15, a cover plate 6 is mounted on a top portion of a body of the sleeve ring 15, and the cover plate 6 is movably mounted and is configured to allow an umbrella pole to be inserted. The cross support mechanism 7 further includes a long rod 10 and a short rod 14, the long rod 10 and the short rod 14 are disposed perpendicular to each other, and two ends of a body of the long rod 10 are fixed to the table plate A 1 and the table plate B 2 through a screw A 11. A short handle 12 is disposed on two ends of a body of the short rod 14 respectively, and the short handle 12 is fixed to the table plate A 1 and the table plate B 2 through a screw B 13. After the table plate A 1 is docked with the table plate B 2, the cross support mechanism 7 is mounted on a bottom portion at a docked position between the table plate A 1 and the table plate B 2 through the bolt. The middle portion of the cross support mechanism 7 is an annular body, and the annular body is sleeved on the outer wall of the sleeve ring 15. The total length of the body of the sleeve ring 15 is greater than the total thickness of the table plate A 1 and the cross support mechanism 7. The long rod 10 and the short rod 14 are vertically disposed on the body of the cross support mechanism 7. The two ends of the long rod 10 are provided with a penetrating hole of the screw A 11 respectively, the short handle 12 is disposed at the two ends of the body of the short rod 14 respectively, and each short handle 12 is provided with a penetrating hole of the screw B 13 respectively. After the table plate A 1 is docked with the table plate B 2, the cross support mechanism is disposed on the bottom portion at the docked position, and the cross support mechanism enhances stability and firmness of the square table. The middle portion of the cross support mechanism is sleeved on the sleeve ring, the sleeve ring penetrates and adapts to the entire thickness of the square table, and stability of the table plate A, the table plate B, and the cross support mechanism is further enhanced through the sleeve ring.

The present invention further provides a technical principle of an easy-to-transport square table, which is as follows: when the user needs to divide the square table into the table plate A and the table plate B, the cross support mechanism mounted on the bottom portions of the table plate A and the table plate B is first detached. After a plurality of screws of the long rod and the short rod in the cross support mechanism are detached, the cross support mechanism is removed from a lower portion of the sleeve ring. The cross support mechanism is configured to enhance stability and support strength of the docked position between the table plate A and the table plate B. The sleeve ring is removed from an upper portion of the square table, and semiarc shapes are symmetrically disposed at the docked position between the table plate A and the table plate B respectively. The semiarc shapes on the bodies of the table plate A and the table plate B are spliced to form a penetrating hole, and the penetrating hole adapts to the sleeve ring. After the sleeve ring is removed from the upper portion of the square table, the screws in the liner and the extension hole that are in the frame are detached. After the screws are detached, the user pulls any one of the table plate A and the table plate B. In the table plate A and the table plate B, the frame A and the frame B are embedded into each other, to enhance the entire stability and firmness of the frame. In the embodiment, the user pulls the frame A to slide out of the frame B. The liner is disposed on the body of the frame A, and the liner adapts to and horizontally slides in the extension hole. After the table plate A and the table plate B are pulled out, the bolts on the top portion of the table leg are detached respectively. A plurality of parts and components, the table leg, the screw, the sleeve ring, the cross support mechanism, the frame A, and the frame B are packed and encapsulated for transportation. Compared with traditional transportation method of packing the entire square table, the square table of the present application has a small area, low transportation costs, and better overall stability.

Finally, it should be noted that the above embodiments are only used to illustrate the technical solutions of the present invention rather than limiting thereto. Although the present invention has been described in detail with reference to the above embodiments, those of ordinary skill in the art should understand that the technical solutions recited in the above embodiments may still be modified, or some or all of the technical features thereof may be replaced with equivalents. These modifications or replacements do not make the essence of the corresponding technical solution deviate from the scope of the technical solutions in the embodiments of the present invention.

What is claimed is:

1. An easy-to-transport square table, comprising a square table (4), wherein a table leg (3) is disposed at each of four corners on a bottom portion of the square table (4) respectively, the table leg (3) is connected to a frame (5), a table plate A (1) and a table plate B (2) are disposed on the frame (5) respectively, and the table plate A (1) is docked with the table plate B (2) to form the square table (4); and the frame (5) further comprises a frame A (51) and a frame B (52), a liner (53) is disposed at an extension end of a body of the frame A (51), and the liner (53) adapts to and is embedded in an extension hole (54) provided at an extension end of a body of the frame B (52);

wherein a cross support mechanism (7) is disposed on a bottom portion of a docked surface between the table plate A (1) and the table plate B (2), a middle portion of a body of the cross support mechanism (7) adapts to an outer wall of a sleeve ring (15), a cover plate (6) is mounted on a top portion of a body of the sleeve ring (15), and the cover plate (6) is movably mounted and is configured to allow an umbrella pole to be inserted.

2. The easy-to-transport square table according to claim 1, wherein an angle block (8) is disposed on bottom portions at two corners of the body of the frame A (51) respectively, the liner (53) is disposed at the extension end of the body of the frame A (51), and a side surface of a body of the liner (53) is provided with a penetrating hole (55) in a penetrating manner.

3. The easy-to-transport square table according to claim 1, wherein an angle block (8) is disposed on bottom portions at two corners of the body of the frame B (52) respectively, the extension end of the body of the frame B (52) is provided with the inner cavity extension hole (54), and a side surface of a body of the extension hole (54) is provided with a penetrating hole A (56) in a penetrating manner.

4. The easy-to-transport square table according to claim 1, wherein a penetrating hole (55) on a body of the liner (53) overlaps and adapts to a penetrating hole A (56) on a body of the extension hole (54).

5. The easy-to-transport square table according to claim 1, wherein the cross support mechanism (7) further comprises a long rod (10) and a short rod (14), the long rod (10) and the short rod (14) are disposed perpendicular to each other, and two ends of a body of the long rod (10) are fixed to the table plate A (1) and the table plate B (2) through a screw A (11).

6. The easy-to-transport square table according to claim 5, wherein a short handle (12) is disposed on two ends of a body of the short rod (14) respectively, and the short handle (12) is fixed to the table plate A (1) and the table plate B (2) through a screw B (13).

7. The easy-to-transport square table according to claim 1, wherein a top portion of the table leg (3) adapts to and abuts against an angle block (8), and the angle block (8) fixes the table leg (3) through a plurality of bolts (9).

8. The easy-to-transport square table according to claim 1, wherein the table plate A (1) and the table plate B (2) are integrally formed with any one of the frame A (51) and the frame B (52) respectively.

* * * * *